US006423257B1

(12) United States Patent
Stobart et al.

(10) Patent No.: US 6,423,257 B1
(45) Date of Patent: Jul. 23, 2002

(54) METHOD OF MANUFACTURING A SACRIFICIAL LIMB FOR A DECK PLANK

(75) Inventors: Philip H. Stobart, Worthington; Burch E. Zehner, Gahanna; A. Anthony Groh; William G. Taylor, both of Columbus; Jeffrey R. Brandt, Blacklick, all of OH (US)

(73) Assignee: TimberTech Limited, Columbus, OH (US)

( * ) Notice: Subject to any disclaimer, the term of this patent is extended or adjusted under 35 U.S.C. 154(b) by 0 days.

(21) Appl. No.: 09/413,385

(22) Filed: Oct. 6, 1999

Related U.S. Application Data

(63) Continuation-in-part of application No. 09/162,626, filed on Sep. 29, 1998, now Pat. No. 6,035,588, which is a continuation-in-part of application No. 09/009,283, filed on Jan. 20, 1998, now Pat. No. 6,131,355, which is a continuation-in-part of application No. 08/752,813, filed on Nov. 21, 1996, now Pat. No. 5,836,128.

(51) Int. Cl.[7] ..... B28B 11/12

(52) U.S. Cl. ..... 264/145; 264/296; 52/DIG. 5

(58) Field of Search ..... 52/98, 100, 309.1, 52/573.1, 592.1, 650.3, 745.19, DIG. 5, DIG. 7; 83/13, 861, 875; 264/284, 293, 296, 145, 146, 148

(56) References Cited

U.S. PATENT DOCUMENTS

| | | | | |
|---|---|---|---|---|
| 274,354 A | | 3/1883 | McCarthy et al. | |
| 329,616 A | | 11/1885 | Baldwin | 52/578 |
| 502,289 A | | 8/1893 | Feldmann | 52/578 |
| 1,014,416 A | | 1/1912 | Schweikert | |
| 1,374,082 A | | 4/1921 | Hedges | 52/578 |
| 1,433,896 A | * | 10/1922 | Lord | 52/578 |
| 1,551,544 A | | 9/1925 | Crooks | 52/578 |
| 1,952,536 A | | 3/1934 | Crooks | 52/578 |
| 2,152,694 A | | 4/1939 | Hoover | 20/8 |
| 2,186,684 A | | 1/1940 | Ritter | 52/314 X |
| 2,947,040 A | * | 8/1960 | Schultz | 52/578 X |
| 3,275,727 A | * | 9/1966 | Irvin | 264/146 |
| 3,386,221 A | | 6/1968 | Giovannucci | 52/578 |
| 3,553,919 A | | 1/1971 | Omholt | |
| 3,987,599 A | | 10/1976 | Hines | 52/591.1 |
| 3,998,014 A | * | 12/1976 | Bartels et al. | 52/100 |
| 4,095,913 A | | 6/1978 | Pettersson et al. | 52/592.4 X |
| 4,241,133 A | | 12/1980 | Lund et al. | 428/326 |
| 4,337,607 A | | 7/1982 | Boschetti | 52/573.1 |
| 4,376,144 A | | 3/1983 | Goettler | 428/36 |
| 4,526,418 A | | 7/1985 | Martin | 52/483.1 X |
| 4,807,416 A | | 2/1989 | Parasin | 52/573.1 |
| 5,033,147 A | | 7/1991 | Svensson | 52/747.1 |
| 5,182,892 A | | 2/1993 | Chase | 52/539 |
| 5,335,473 A | | 8/1994 | Chase | 52/745.08 |
| 5,351,915 A | | 10/1994 | Aandalen | 52/483.1 X |
| 5,410,855 A | | 5/1995 | Clausen et al. | 52/747.1 |
| 5,411,782 A | | 5/1995 | Jarvis et al. | 52/580 X |
| 5,516,472 A | | 5/1996 | Laver | 264/118 |
| 5,647,184 A | * | 7/1997 | Davis | 52/100 X |
| 5,836,128 A | * | 11/1998 | Groh et al. | 52/314 X |
| 6,035,588 A | * | 3/2000 | Zehner et al. | 52/314 X |

FOREIGN PATENT DOCUMENTS

| | | |
|---|---|---|
| EP | 93306843.9 | 8/1993 |
| EP | 93306845.4 | 8/1993 |

* cited by examiner

*Primary Examiner*—Michael Safavi
(74) *Attorney, Agent, or Firm*—Standley & Gilcrest LLP

(57) ABSTRACT

A method of manufacturing a sacrificial limb for a deck plank provides a deck plank that is comprised of a wood replacement material. The deck plank has a tongue that is adapted to fit with a groove of an adjacent deck plank. A channel is cut in the tongue of the deck plank. The channel is adapted to induce the tongue to fracture when expansion of the wood replacement material causes sufficient pressure between the tongue and the groove of the adjacent deck plank. As a result, expansion and contraction of the deck plank material preferably does not cause the deck to buckle.

25 Claims, 8 Drawing Sheets

METHOD OF MANUFACTURING A SACRIFICIAL LIMB FOR A DECK PLANK

This is a continuation-in-part of U.S. application Ser. No. 09/162,626, filed Sep. 29, 1998, now U.S. Pat. No. 6,035,588. U.S. application Ser. No. 09/162,626 is a continuation-in-part of U.S. application Ser. No. 09/009,283, filed Jan. 20, 1998, now U.S. Pat. No. 6,131,355. U.S. application Ser. No. 09/009,283 is a continuation-in-part of U.S. application Ser. No. 08/752,813, filed Nov. 21, 1996, now U.S. Pat. No. 5,836,128.

BACKGROUND AND SUMMARY OF THE INVENTION

The present invention relates generally to decks, and more particularly, to a method of manufacturing a sacrificial limb for a deck plank.

Wood is commonly used for decks. However, the use of wood for decks presents a number of problems. First, constant exposure to the elements can cause the wood to deteriorate over time. In order to prevent (or delay) this from happening, the wood must be treated with a wood preservative. Treating the wood can be a time consuming and messy process. In addition, wood is frequently stained or painted to achieve a desired color, but the color can fade, chip, and peel over time.

In addition, the dimensions of wood vary depending on the moisture content of the wood and the temperature. These variations can cause warping of the boards which can cause the surface of the deck to become uneven over time. Finally, when a tongue and groove arrangement of boards is used, if the head of the nail is not flush with the surface of the board, the next board will not fit against it properly, resulting in an uneven surface.

Synthetic wood compositions have been advanced as a substitute for natural wood. Synthetic wood compositions may offer improved durability and enhanced moisture resistance over natural wood. Nevertheless, synthetic wood compositions may still expand and contract as a result of temperature and moisture variations. Consequently, a deck made from synthetic wood deck planks may also become uneven due to expansion and contraction of the synthetic wood material.

Therefore, it is desirable to have a method of making an improved tongue and groove joint. It is also desirable to have a method of making a sacrificial limb for a deck plank so that the deck plank has improved dimensional stability and decreased maintenance. The method preferably ensures that the deck will remain smooth and even after it is installed. In particular, the method preferably enables the tongue-and-groove joint between deck planks to compensate for expansion and contraction of the material of the deck planks.

The present invention satisfies some or all of these needs. The present invention provides a method of manufacturing a sacrificial limb for a deck plank. The sacrificial limb is preferably adapted to fracture, if necessary, in response to expansion of the material of the deck plank to limit vertical displacement of the top surface of the deck plank.

A preferred method of manufacturing a sacrificial limb of the present invention starts by providing a deck plank that is comprised of a wood replacement material. The deck plank has a tongue that is adapted to fit with a groove of an adjacent deck plank. The adjacent deck plank may be substantially similar to the provided deck plank. A channel is cut in the tongue of the provided deck plank. The channel is adapted to induce the tongue to fracture when expansion of the wood replacement material causes sufficient pressure between the tongue and the groove of the adjacent deck plank.

The deck plank may be provided by any appropriate means, e.g., extrusion or molding. In a preferred method, the channel is substantially straight, and it extends the entire length of the deck plank. The channel may be cut in any appropriate place on the tongue. For example, the channel may be cut in a bottom edge or a top edge of the tongue.

The tongue of the deck plank preferably includes a recess that divides the tongue into a first limb and a second limb. The deck plank may be provided with the recess. Alternatively, the method may further include cutting a recess in the tongue. The recess preferably extends in a plane that is substantially parallel to a top surface of the deck plank. In such embodiments, the channel may be cut in an edge of the tongue that defines the recess.

The deck plank may be made from wood, plastics, or from several other materials including conventional wood replacement materials such as synthetic wood compositions. However, it is believed that the present invention is unique apart from material considerations. The wood replacement material may be comprised of a polymer, such as homopolymers and copolymers of polyethylene, polyvinyl chloride, polypropylene and ABS, or a mixture of these polymers. The wood replacement material also preferably includes cellulose material for appearance, stiffness, and economics. The cellulose material may be in the form of fibers (e.g., wood flour and the like). Table 1 shows an example formulation of a wood replacement material. The deck planks made from wood replacement materials are preferably extruded using conventional plastics extrusion equipment and one or more dies to provide the desired cross section shape of each plank.

TABLE 1

| | |
|---|---|
| Wood Flour | 50% (by weight) |
| HDPE | 45% (by weight) |
| Lubricants | 2.5% (by weight) |
| Other Additives | 2.5% (by weight) |

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

The present invention is directed to a method of making a sacrificial limb for a deck plank. The deck plank is preferably comprised of a wood replacement material. The deck plank is preferably adapted to be connected to another deck plank by a tongue-and-groove arrangement. The tongue of the deck plank is or includes the sacrificial limb. The sacrificial limb is adapted to fracture when expansion of the material of adjacent deck planks causes sufficient pressure between the tongue of one deck plank and the groove of the other deck plank.

Figure 1:
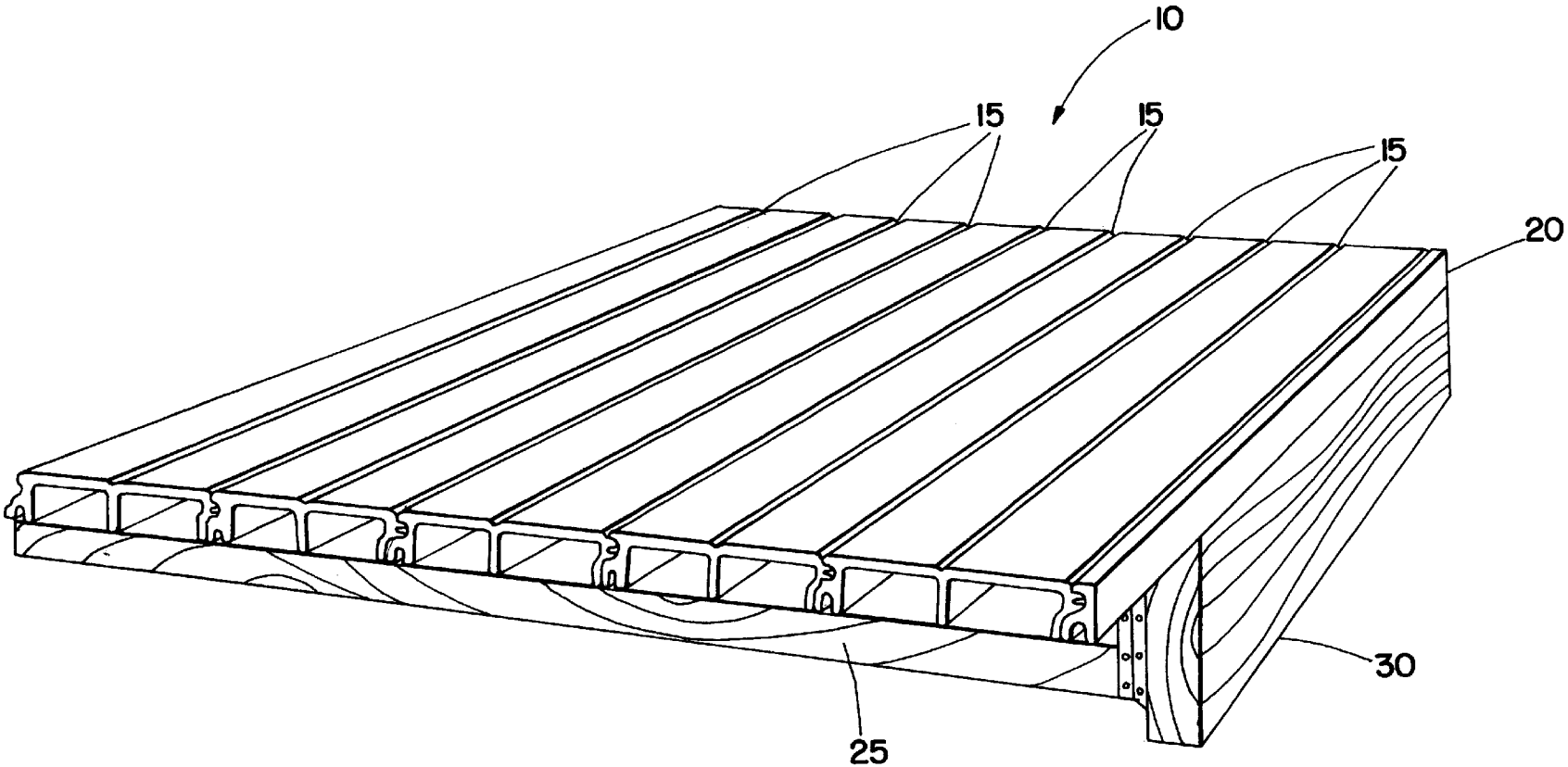
FIG. 1 is a partial perspective view of one embodiment of a deck that may utilize a preferred method of the present invention.

Examples of deck planks will now be described which have sacrificial limbs that are preferably made by a preferred method of the present invention. FIG. 1 generally shows a preferred embodiment of a deck 10. The deck 10 is comprised of a series of deck planks 15 and a starter strip 20. The deck 10 may be supported by a support structure. In this example, the support structure includes a ledger 30 and joists 25 (only one shown) perpendicular to the ledger 30.

Figure 2:
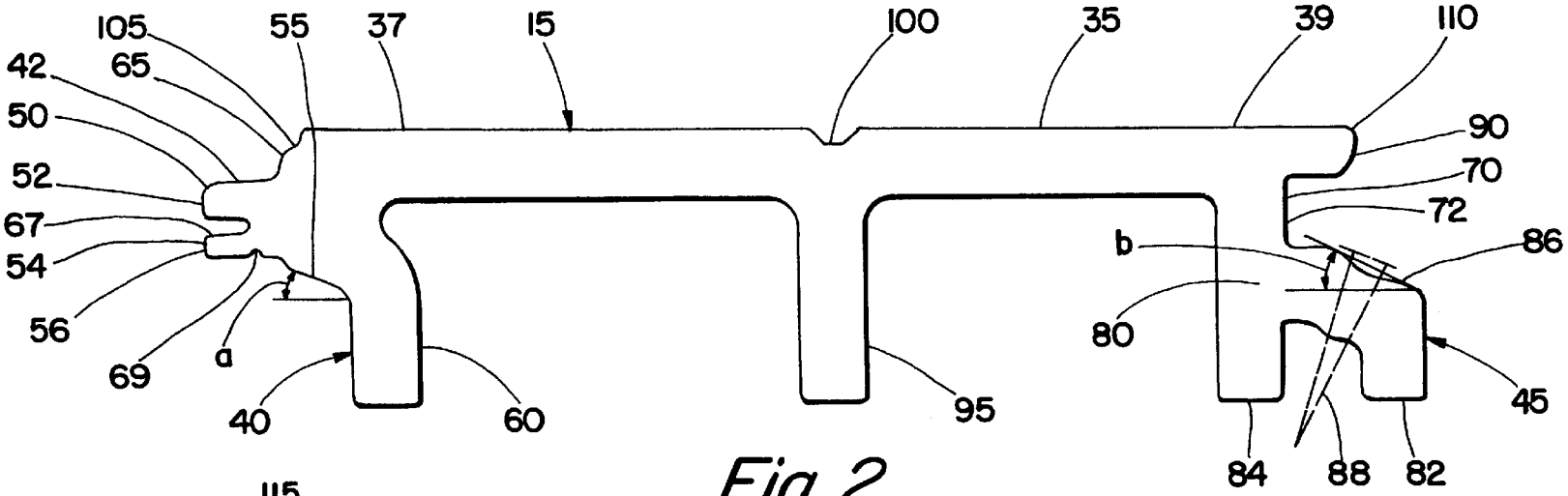
FIG. 2 is a cross section view of one embodiment of a deck plank that may utilize a preferred method of the present invention.

A preferred embodiment of a deck plank 15 is shown in more detail in FIG. 2. The deck plank 15 has a horizontal top surface 35. The top surface 35 of the deck plank, for example, may be approximately 0.375 inches thick. The top surface 35 may be roughened to provide better traction or to simulate the appearance of natural wood. The deck plank 15 may be made in many lengths including a variety of standard lengths, e.g. 8, 10, and 12-foot lengths. The weight of the deck plank 15 may be greatly reduced as compared to a solid plank due to the material reduction.

A leg 40 is attached to one end portion 37 of the deck plank 15, and a leg 45 is attached to the opposite end portion 39 of the deck plank 15. The leg 40 may include a tongue 50, an angled portion 55, a lower portion 60, and an upper portion 65. The angled portion 55 extends from the lower portion 60 to the tongue 50. The angle "a" of the angled portion 55 is measured relative to horizontal. The angle "a" is preferably approximately 25°.

It is preferred that the outer portion 56 of the tongue 50 has a substantially vertical edge. In addition, the tongue 50 preferably has a limb 52 and a limb 54. The limb 52 and the limb 54 define a recess 67. The recess 67 is adapted to allow each of the limbs 52, 54 to flex in response to a sufficient amount of pressure. As a result, the recess 67 preferably allows for some expansion and contraction of the material of the deck plank 15 when the tongue of the deck plank 15 is placed in a groove of an adjacent deck plank.

The outer surface 42 of the leg 40 defines a channel 69. At least a portion of the channel 69 extends along the tongue 50. It is preferred that the channel 69 extends along the tongue 50 for the length of the deck plank 15. In this example, the channel 69 extends along an edge of the limb 54. In another preferred embodiment, the channel 69 may extend along an edge of the limb 52. It should also be recognized that one channel 69 may extend along an edge of one of the limbs 52, 54 while another channel 69 extends along an edge of the other limb 52, 54. Moreover, it should be recognized that a channel 69 may extend along an edge of the tongue that defines the recess 67.

If necessary, the channel 69 is adapted to further compensate for expansion and contraction of the material of the deck plank 15. When the tongue 50 of the deck plank 15 is placed in a groove of an adjacent deck plank, the channel 69 is adapted to induce the tongue 50 to fracture when expansion of the material of the deck planks causes sufficient pressure between the tongue 50 and the groove of the adjacent deck plank. The fracture is preferably adapted to limit vertical displacement of the top surface 35 of the deck plank 15 due to material expansion and contraction. Specifically, the channel 69 in this example preferably allows the limb 54 to adjust to expansion of the deck material so that the joint between the deck planks does not cause the surface of the deck to become uneven.

The leg 45 has a lower portion 80 and an upper portion 90. The lower portion 80 and the upper portion 90 define a groove 70. The groove 70 is adapted to receive the tongue of an adjacent deck peck. The inner portion 72 of the groove 70 preferably has a substantially vertical edge.

The lower portion 80 may include a first lower portion 82, a second lower portion 84, and an angled portion 86. The angled portion 86 extends from the first lower portion 82 to about the inner portion 72 of the groove 70. The angle "b" of the angled portion 86 is measured relative to horizontal. The angle "b" of the leg 45 is preferably more than the angle "a" of the tongue, and preferably is approximately 28°. The inner portion 72 may extend substantially vertically upward from the end of the angled portion 86 to the upper portion 90. The first lower portion 82, the second lower portion 84, the angled portion 86, and the inner portion 72 preferably form a generally "h" shape. A fastener 88 may be installed at the angled portion 86 to penetrate the first lower portion 82 and an underlying structure member 25 to thereby secure the deck plank 15 to the support structure.

The deck plank 15 preferably has a vertical support leg 95. The vertical support leg 95 may extend downward perpendicularly from the top surface 35 of the deck plank 15. The vertical support leg 95 provides support for the top surface 35 of the deck plank. Above the vertical support leg 95 may be a channel 100 in the top surface 35 which may extend the length of the deck plank.

A partial notch 105 may be formed in the upper portion 65 of the leg 40. The upper portion 90 of the leg 45 may have a complementary portion 110 to a notch 105. When two deck planks are put together, the partial notch 105 of one deck plank may be mated with the complementary portion 110 of the second deck plank to form a generally complete notch.

Figure 3:
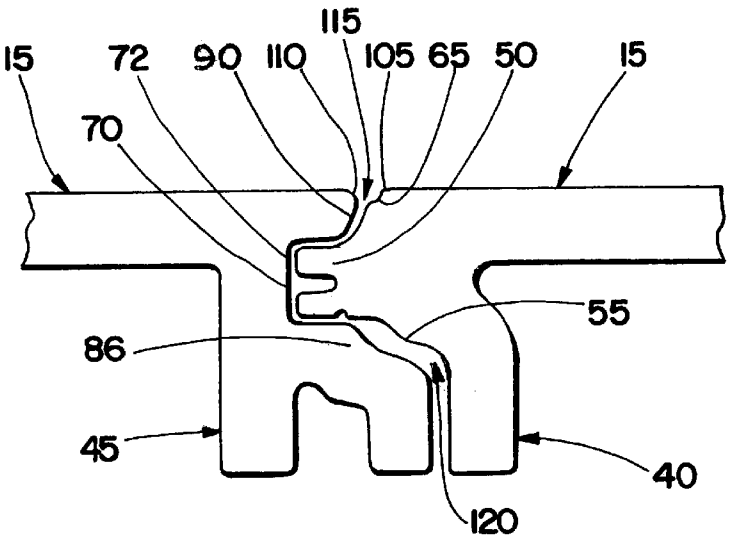
FIG. 3 is a partial cross section view of one embodiment of a tongue and groove joint between deck planks that may utilize a preferred method of the present invention.

FIG. 3 shows a joint between two deck planks. The leg 40 of one deck plank is mated with the leg 45 of an adjacent plank. The tongue 50 of the leg 40 is positioned adjacent to the inner portion 72 of the groove 70. The upper portion 90 of the leg 45 is adjacent to the upper portion 65 of the leg 40. The partial notch 105 of the upper portion 65 of the leg 40 and the complementary portion 110 of the upper portion 90 of the leg 45 form a generally complete notch.

There is preferably a gap 115 between the upper portion 65 of the leg 40 and the upper portion 90 of the leg 45 of the adjacent plank below the partial notch 105 and the complementary portion 110. Water which flows into the notch may continue downward into the gap 115. From there, the water may flow along the gap 115 to vertical cutouts in the tongue 50 of the plank (not shown in FIG. 3). The water may then flow down through the vertical cutouts and out the bottom of the plank through the space 120. The space 120 is maintained between the angled portion 55 of the leg 40 and the angled portion 86 of the leg 45 due to the difference between the angles "a" and "b".

A deck plank 15 may be made in different widths, e.g. 6 inch and 12 inch widths, and may have different numbers of channels 100. The channels 100 in the top surface 35 may provide the deck plank 15 with the look of a series of smaller boards. For instance, if the deck plank 15 is approximately 6 inches in width with one channel 100, it may appear to be two 3-inch boards. A 12-inch deck plank 15 with three channels 100 may appear to be four boards of about 3 inches each. However, rather than having to nail four boards per foot of decking, the 6 inch deck plank 15 may only require two nails per foot, while the 12 inch deck plank 15 may only require one nail.

Figure 4:
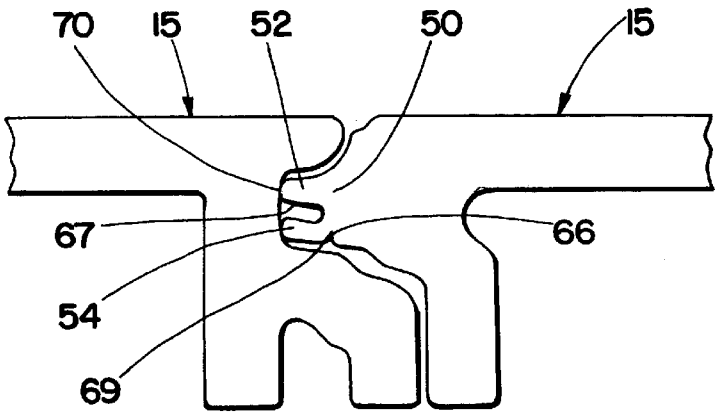
FIG. 4 is a partial cross section view of the tongue and groove joint of FIG. 3 after expansion of the deck material has caused one of the limbs of the tongue to fracture.

FIG. 4 is an example of how a tongue 50 may compensate for expansion of the material of adjacent deck planks 15 so that the effect on the top surface of a deck is limited. The deck planks 15 may expand horizontally as well as vertically. The recess 67 allows the limb 54 to compress upward as the material expands. As the expanding material continues to exert pressure on the limb 54, the channel 69 may induce a fracture 66 of the limb 54. The fracture 66 allows the limb 54 to compress further upward so that the tongue 50 does not back out of the groove 70. As a result, the joint between the deck planks 15 preferably does not buckle, and vertical displacement of the deck planks 15 is limited.

Figure 5:
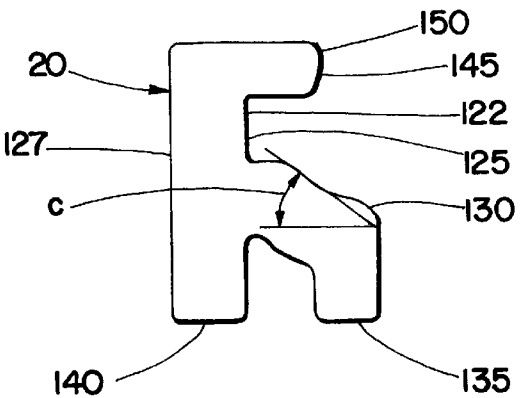
FIG. 5 is a cross section view of a preferred embodiment of a starter strip for a deck.

An example of a starter strip 20 is shown in FIG. 5. The starter strip 20 has a groove 122. The groove 122 is adapted to receive the tongue 50 of a deck plank 15. An inner portion 125 of the groove 122 preferably has a substantially vertical edge.

A starter strip 20 may be comprised of a leg 127 that is shaped similarly to a leg 45 of a deck plank 15. Accordingly, a starter strip 20 may further include an angled portion 130, a first lower portion 135, a second lower portion 140, and an upper portion 145. The upper portion 145 may have a complementary portion 150 of a notch. The angle "c" of the angled portion 130 is measured relative to horizontal. The angle "c" is preferably about the same as angle "b".

Figure 6:
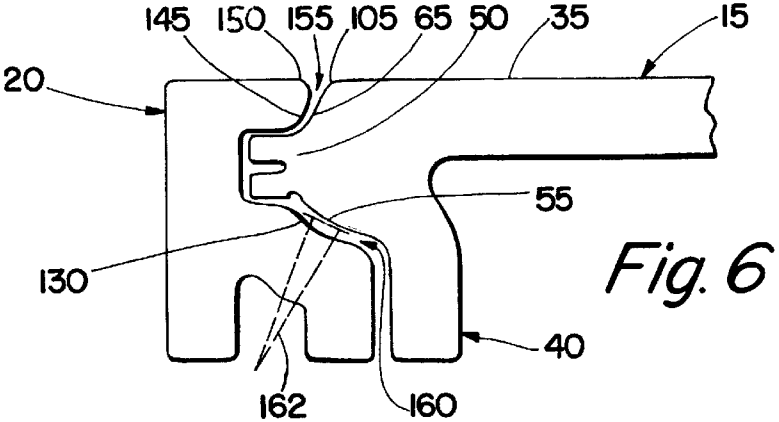
FIG. 6 is a partial cross section view of one embodiment of a tongue and groove joint between a deck plank and a starter strip that may utilize a preferred method of the present invention.

An example of a joint between a starter strip 20 and a deck plank 15 is shown in FIG. 6. The leg 40 of the deck plank 15 is mated with the starter strip 20. The tongue 50 of the leg 40 is positioned adjacent to the inner portion 125 of the starter strip 20. The upper portion 145 of the starter strip 20 is adjacent to the upper portion 65 of the leg 40. The partial notch 105 of the upper portion 65 of the leg 40 and the complementary portion 150 of the upper portion 145 of the starter strip 20 may form a complete notch. There may be a gap 155 between the upper portion 65 of the leg 40 and the upper portion 145 of the starter strip 20 below the partial notch 105 and the complementary portion 150. A space 160 may be maintained between the angled portion 55 of the leg 40 and the angled portion 130 of the starter strip 20 due to the difference between the angles "a" and "c". A fastener 162 may be installed to penetrate the starter strip 20 and secure it to an underlying structure member. In addition, it should be recognized that the tongue 50 may compensate for expansion of the material of the starter strip 20 and the deck plank 15 in a manner similar to the one previously discussed with reference to FIG. 4.

Figure 7:
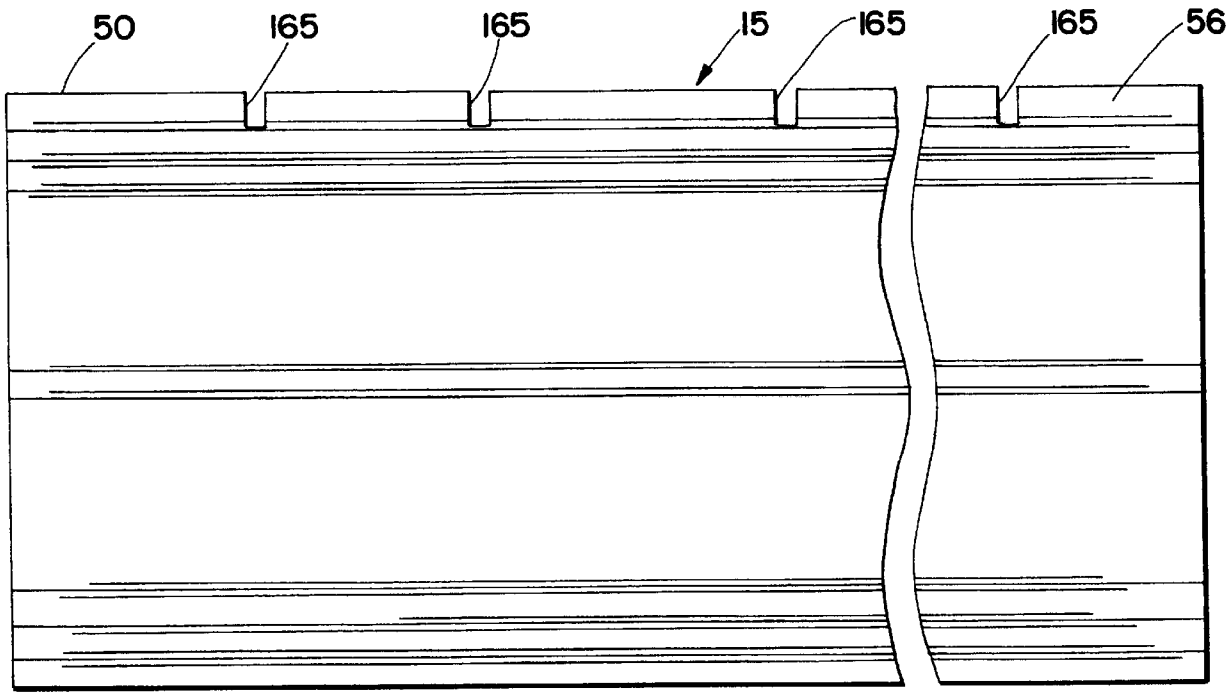
FIG. 7 is a top plan view of one embodiment of a deck plank that may utilize a preferred method of the present invention.

FIG. 7 shows a top plan view of a preferred embodiment of a deck plank 15. The deck plank 15 may have a series of vertical cutouts 165 in the leg 40. The vertical cutouts 165 may extend through the outer portion 56 of the tongue 50. The vertical cutouts 165 may be placed at different locations along the length of the plank 15, for example, every twelve inches. Water which flows into the joint between the tongue of one plank and the groove of the next may flow downward through the vertical cutouts 165 and out through the gap 120 between adjacent planks 15. The combination of the gap 115 (and 155), the vertical cutouts 165, and the space 120 (and 160) helps to reduce the buildup of water on the surface of the deck.

A deck may be made in the following manner. The starter strip 20 may be nailed, screwed, stapled or otherwise attached to the ledger 30 at intervals along its length. The nails (or other attachments) 162 preferably extend through the angled portion 130 of the starter strip 20 into the ledger 30. A deck plank 15 may then be placed next to the starter strip 20. The tongue 50 of the deck plank may be positioned adjacent to the inner portion 125 of the starter strip 20. The space 160 between the angled portion 130 of the starter strip 20 and the angled portion 55 of the leg 40 preferably allows room for nails 162 which are not flush with the surface of the angled portion 130. This provides a smooth, even fit between the starter strip 20 and the deck plank 15 even if the head of the fastener 162 extends upward slightly from the surface of the angled portion 130.

The deck plank 15 may then be fastened to the joists 25 along its length. The deck plank 15 may be nailed, or otherwise fastened, through the angled portion 86 of the leg 45. A second deck plank 15 may then be placed into position, and the process repeated. The space 120 between the angled portion 86 of the leg 45 of the first deck plank 15 and the angled portion 55 of the leg 40 of the second deck plank 15 again preferably allows room for the head of nails or other fasteners which may extend upward slightly from the surface of the angled portion 86.

Figure 8:
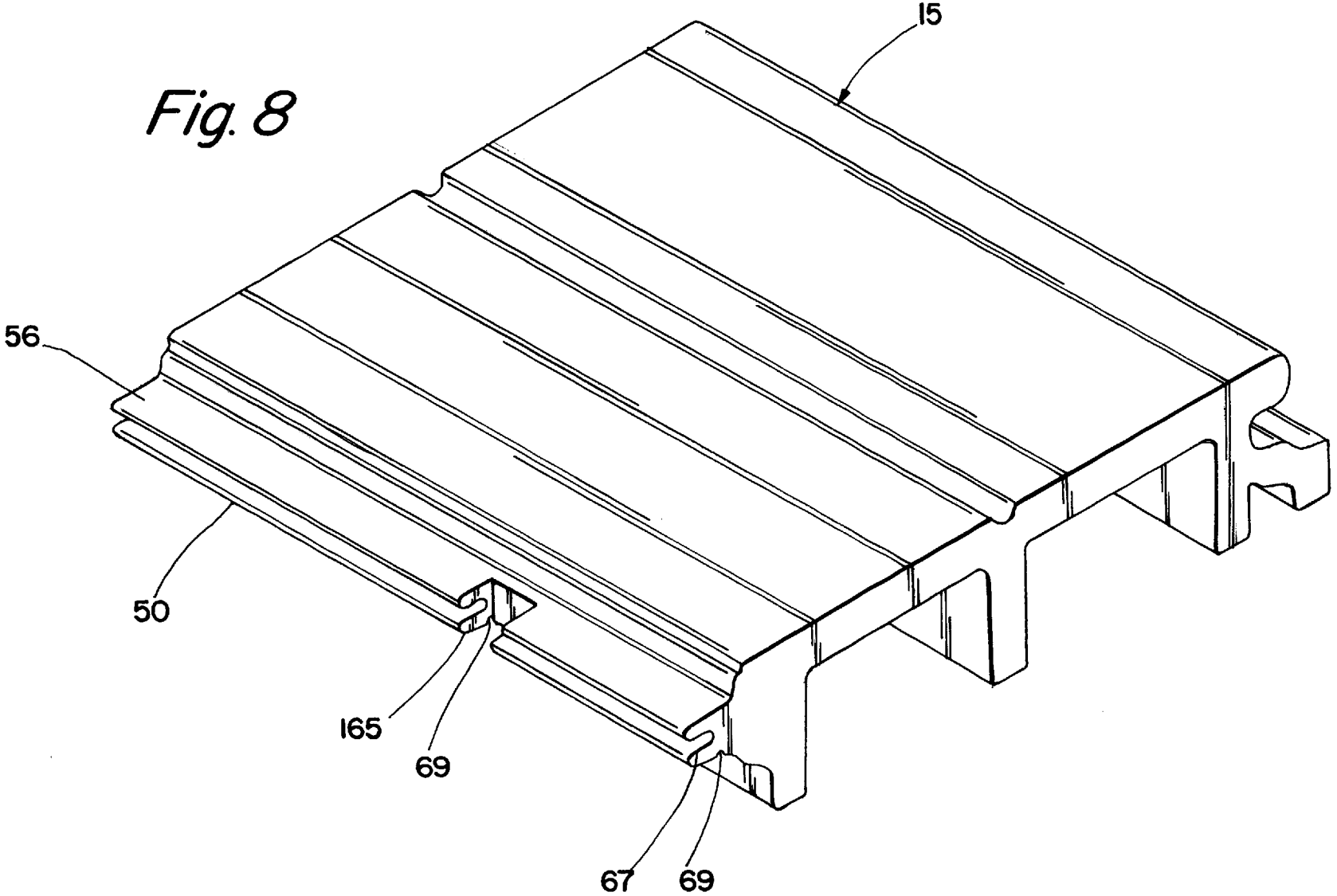
FIG. 8 is a perspective view of one embodiment of a deck plank that may utilize a preferred method of the present invention.
Figure 9:
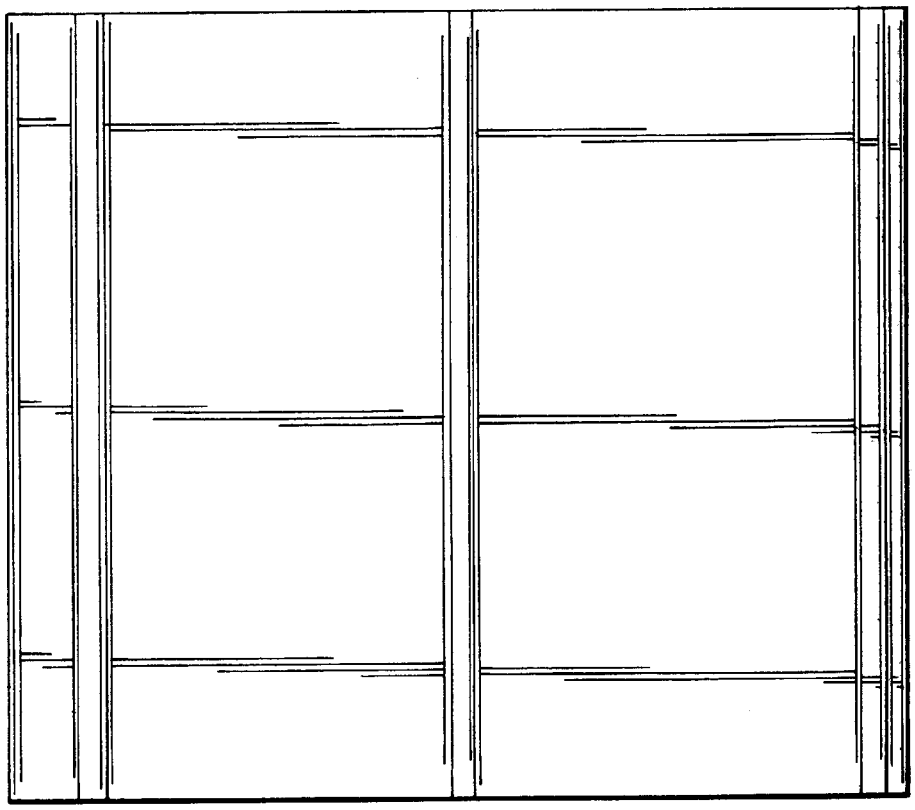
FIG. 9 is a top plan view of one embodiment of a deck plank that may utilize a preferred method of the present invention.
Figure 10:
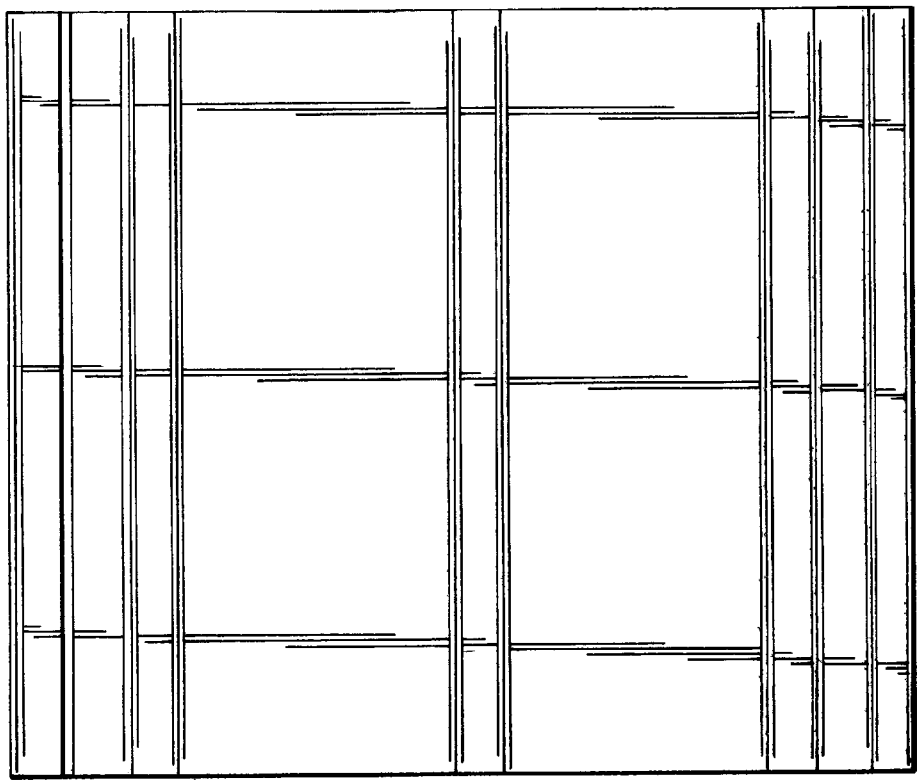
FIG. 10 is a bottom plan view of the deck plank of FIG. 9.
Figure 11:
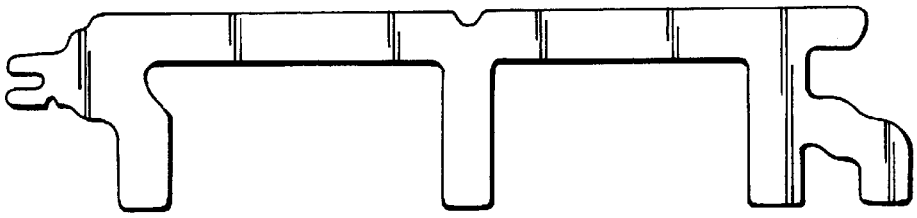
FIG. 11 is a side elevation view of the deck plank of FIG. 9.
Figure 12:
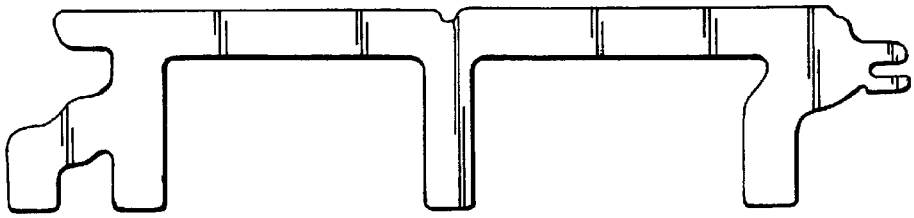
FIG. 12 is an opposite side elevation view of the deck plank of FIG. 9.
Figure 13:
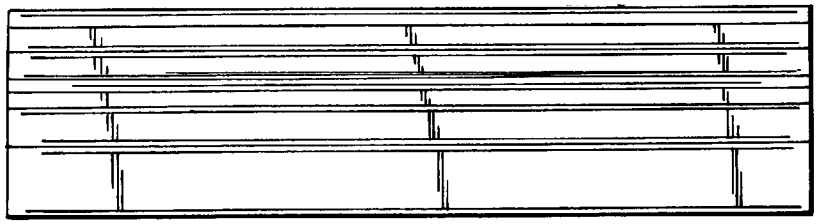
FIG. 13 is an end elevation view of the deck plank of FIG. 9.
Figure 14:
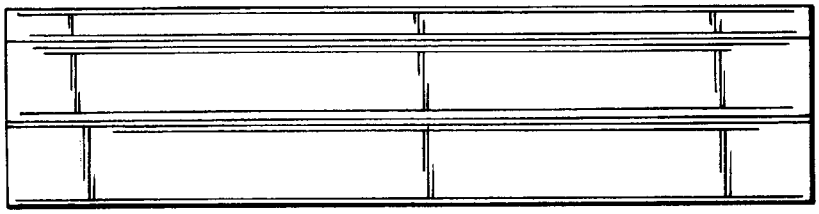
FIG. 14 is an opposite end elevation view of the deck plank of FIG. 9.

FIG. 8 is a perspective view of a preferred embodiment of a deck plank 15. In this embodiment, a channel 69 extends horizontally along the tongue 50. The tongue 50 defines a recess 67. A vertical cutout 165 extends through the outer portion 56 of the tongue 50.

FIGS. 9 through 14 need no further discussion as they are merely design drawings of a preferred embodiment of a deck plank 15.

Figure 15:
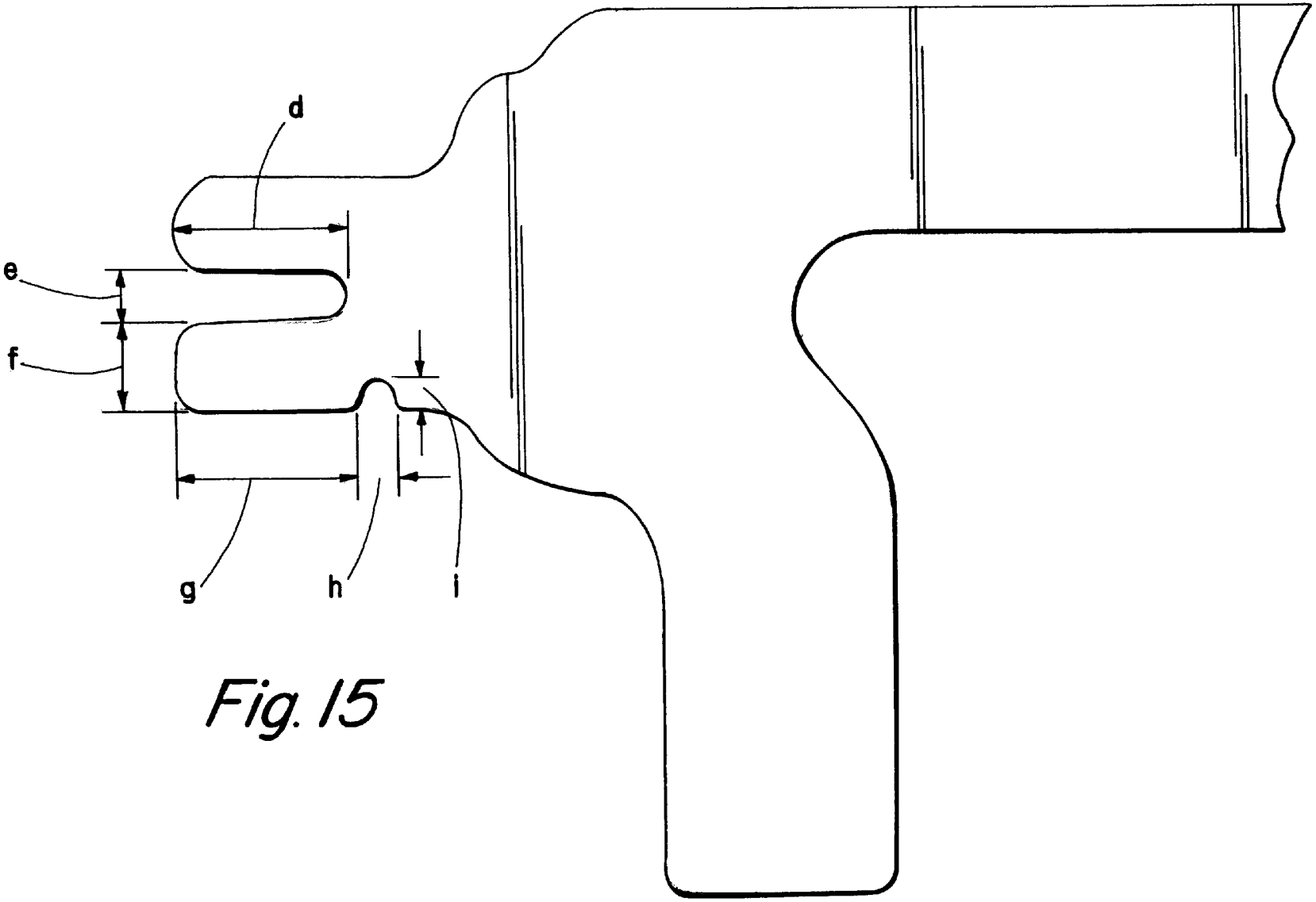
FIG. 15 is a detailed partial side elevation view of one embodiment of a deck plank that may utilize a preferred method of the present invention.

FIG. 15 shows one example of the dimensions of a tongue of a deck plank. As indicated by arrows d and e, the limbs of the tongue define a recess that is 0.2364 inch deep and 0.0788 inch wide. The sacrificial limb is 0.1379 inch thick as indicated by the arrow f. Arrow g shows the distance from the substantially vertical edge of the sacrificial limb to the channel. The channel is located 0.2561 inch from the substantially vertical edge of the sacrificial limb. The channel is 0.0394 inch deep and wide as indicated by arrows h and i.

It is preferred to cut the channel in the tongue after the main body of the deck plank has been produced. For example, it is preferred to extrude or mold the deck plank and then cut the channel in the tongue of the deck plank. For deck planks produced by extrusion, the channel may be cut in the deck plank immediately after the deck plank passes through the cooling tank. In addition, the recess may also be cut in the tongue after the formation of the main body of the deck plank. The channel and recess can be cut in the tongue by any appropriate device(s). For example, the channel and the recess can be cut by a circular saw, a router, or any other appropriate type of cutting device.

The method of the present invention preferably offers several advantages over extruding or molding the channel. For instance, the method of the present invention preferably enables the deck plank to be extruded or molded at a greater rate resulting in lower cost per output. In addition, the method of the present invention preferably enables the dimensions of the channel and, optionally, the recess to be changed more easily from product batch to product batch. For example, the deck plank of one product batch may require a sacrificial limb that fractures under a different amount of pressure than the sacrificial limb of a deck plank of another product batch. In such situations, the method of the present invention preferably does not require the die or mold to be swapped out. Instead, the cutting device and/or the dimensions or shape of the cut can be changed to make a sacrificial limb that is appropriate for the application. Finally, the method of the present invention preferably enables a thinner channel to be made as opposed to a channel which is extruded or molded.

Figure 16:
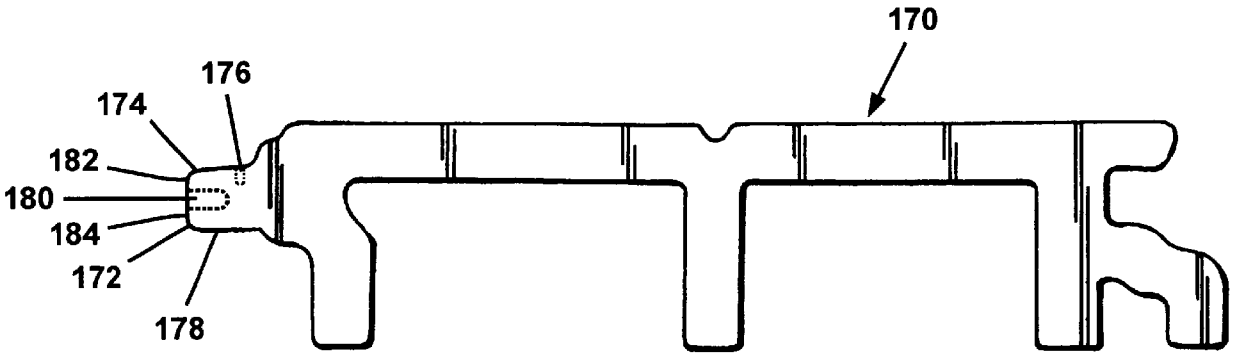
FIG. 16 is a cross section view of one embodiment of a deck plank prior to making the cuts of one preferred method of the present invention.

FIG. 16 shows an example of a deck plank 170 prior to making the cuts of a preferred method of the present invention. The dashed lines indicate the preferred locations of the cuts. The tongue 172 of the deck plank 170 is initially provided without a recess or a channel. In this example, a channel is created by making a cut in the top edge 174 to remove the portion 176. Optionally, a recess may be created by making another cut to remove the portion 180. This would create a limb 182 and a limb 184, and it would enable the tongue to adjust more effectively to the expansion and contraction of the deck plank material. In this embodiment, it should also be recognized that a channel could be cut in the bottom edge 178 or in an edge created by the removal of the portion 180.

Figure 17:
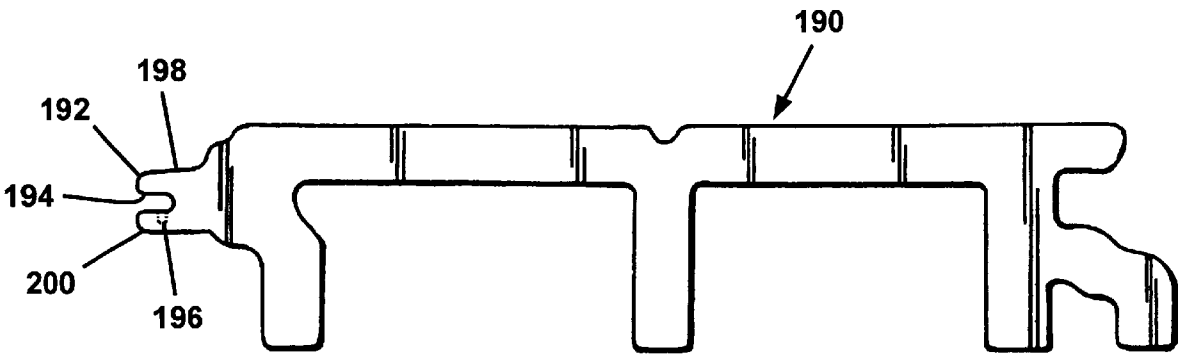
FIG. 17 is a cross section view of one embodiment of a deck plank prior to making the cuts of another preferred method of the present invention.

FIG. 17 shows an example of a deck plank 190 prior to making the cuts of another method of the present invention. Again, the dashed line indicates the preferred location of the cut. The deck plank 190 is provided with a tongue 192 that has a recess 194. A channel is created by making a cut in the edge of the recess 194 to remove the portion 196. Additionally or alternatively, a channel may be cut in the top edge 198 or the bottom edge 200 of the tongue 192.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A method of manufacturing a sacrificial limb for a deck plank that is comprised of a wood replacement material, said method comprising:

extruding said deck plank, said deck plank having a tongue that is adapted to fit with a groove of an adjacent deck plank; and cutting a channel in said tongue, said channel adapted to induce said tongue to fracture when expansion of said wood replacement material causes sufficient pressure between said tongue and said groove of said adjacent deck plank.

2. The method of claim 1 wherein said channel is cut in a bottom edge or a top edge of said tongue.

3. The method of claim 1 wherein said channel extends the entire length of said deck plank.

4. The method of claim 1 wherein said channel is substantially straight.

5. The method of claim 1 wherein said channel is less than about 0.1379 inch deep.

6. The method of claim 1 further comprising cutting a recess in said tongue, said recess dividing said tongue into a first limb and a second limb.

7. The method of claim 6 wherein said recess extends in a plane that is substantially parallel to a top surface of said deck plank.

8. The method of claim 6 wherein said channel is cut in an edge of said tongue that defines said recess.

9. A method of manufacturing a sacrificial limb for a deck plank that is comprised of a wood replacement material, said method comprising:

extruding said deck plank, said deck plank having a tongue that is adapted to fit with a groove of an adjacent deck plank, said tongue having a first limb and a second limb, said first limb and said second limb defining a recess; and cutting a channel in said tongue, said channel adapted to induce said tongue to fracture when expansion of said wood replacement material causes sufficient pressure between said tongue and said groove of said adjacent deck plank.

10. The method of claim 9 wherein said channel is cut in a bottom edge or a top edge of said tongue.

11. The method of claim 9 wherein said channel is cut in an edge of said tongue that defines said recess.

12. The method of claim 9 wherein said channel extends the entire length of said deck plank.

13. The method of claim 9 wherein said channel is substantially straight.

14. The method of claim 9 wherein said channel is less than about 0.1379 inch deep.

15. The method of claim 9 wherein said recess extends in a plane that is substantially parallel to a top surface of said deck plank.

16. A method of manufacturing a sacrificial limb for a deck plank that is comprised of a wood replacement material, said method comprising:

extruding said deck plank from a composition comprising a cellulosic filler and a plastic material, said deck plank having a tongue that is adapted to fit with a groove of an adjacent deck plank; and cutting a channel in said tongue, said channel adapted to induce said tongue to fracture when expansion of said wood replacement material causes sufficient pressure between said tongue and said groove of said adjacent deck plank.

17. The method of claim 16 wherein said channel is cut in a bottom edge or a top edge of said tongue.

18. The method of claim 16 wherein said tongue has a first limb and a second limb, said first limb and said second limb defining a recess.

19. The method of claim 18 wherein said channel is cut in an edge of said tongue that defines said recess.

20. The method of claim 18 wherein said recess extends in a plane that is substantially parallel to a top surface of said deck plank.

21. The method of claim 16 wherein said channel extends the entire length of said deck plank.

22. The method of claim 16 wherein said channel is substantially straight.

23. The method of claim 6 further comprising cutting a recess in said tongue, said recess dividing said tongue into a first limb and a second limb.

24. The method of claim 23 wherein said recess extends in a plane that is substantially parallel to a top surface of said deck plank.

25. The method of claim 23 wherein said channel is cut in an edge of said tongue that defines said recess.

* * * * *